US007934952B2

(12) United States Patent
Pera

(10) Patent No.: US 7,934,952 B2
(45) Date of Patent: May 3, 2011

(54) COAXIAL CABLE CONNECTOR SYSTEM AND METHOD

(75) Inventor: Robert J. Pera, San Jose, CA (US)

(73) Assignee: Ubiquiti Networks, San Jose, CA (US)

( * ) Notice: Subject to any disclaimer, the term of this patent is extended or adjusted under 35 U.S.C. 154(b) by 0 days.

(21) Appl. No.: 12/511,703

(22) Filed: Jul. 29, 2009

(65) Prior Publication Data

US 2011/0028032 A1 Feb. 3, 2011

(51) Int. Cl.
*H01R 9/05* (2006.01)

(52) U.S. Cl. ..... 439/578; 439/638

(58) Field of Classification Search ..... 439/578, 439/638, 579, 675
See application file for complete search history.

(56) References Cited

U.S. PATENT DOCUMENTS

| | | | | |
|---|---|---|---|---|
| 3,825,874 | A * | 7/1974 | Peverill | 439/579 |
| 5,503,566 | A * | 4/1996 | Wang | 439/188 |
| 5,782,656 | A * | 7/1998 | Zell et al. | 439/579 |
| 6,036,539 | A * | 3/2000 | Rigby et al. | 439/579 |
| 6,045,402 | A * | 4/2000 | Embo et al. | 439/579 |
| 6,113,431 | A * | 9/2000 | Wong | 439/638 |
| 6,386,913 | B1 * | 5/2002 | Mohammad et al. | 439/579 |
| 6,386,914 | B1 * | 5/2002 | Collins et al. | 439/579 |
| 6,425,783 | B1 * | 7/2002 | Touboul | 439/638 |
| 6,524,119 | B2 * | 2/2003 | Kato et al. | 439/79 |
| 6,679,728 | B1 * | 1/2004 | Huang et al. | 439/579 |
| 6,808,414 | B2 * | 10/2004 | Spiegel et al. | 439/579 |
| 6,945,817 | B2 * | 9/2005 | Miyazaki et al. | 439/579 |
| 6,997,753 | B2 * | 2/2006 | Broomall et al. | 439/638 |
| 7,086,898 | B2 * | 8/2006 | Johnsen et al. | 439/579 |
| 7,244,145 | B2 * | 7/2007 | Johnsen et al. | 439/579 |
| 7,252,555 | B2 * | 8/2007 | Moessinger | 439/700 |
| 7,413,474 | B2 * | 8/2008 | Liu et al. | 439/579 |
| 2004/0209521 | A1 * | 10/2004 | Cooper et al. | 439/638 |
| 2005/0048835 | A1 * | 3/2005 | Clark | 439/579 |
| 2005/0090152 | A1 * | 4/2005 | Broomall et al. | 439/638 |
| 2008/0113552 | A1 * | 5/2008 | Casperson et al. | 439/579 |
| 2009/0191751 | A1 * | 7/2009 | Barsigian et al. | 439/579 |

* cited by examiner

*Primary Examiner* — Gary F. Paumen
(74) *Attorney, Agent, or Firm* — Antero & Tormey LLP; Peter Tormey

(57) ABSTRACT

A connecting device comprising a body having a threaded portion and a sleeve portion. A plurality of coaxial receptacles disposed in the threaded portion, each receptacle formed to couple with element of a coaxial cable connector, and a plurality of coaxial mounts disposed on the sleeve end. The coaxial mounts may be coupled to coaxial leads with each lead having a mini-connectors. The body is substantially similar to a type-n connector and provides for easy coupling of multiple coaxial cables within a single connector housing.

13 Claims, 4 Drawing Sheets

COAXIAL CABLE CONNECTOR SYSTEM AND METHOD

FIELD OF THE INVENTION

The disclosure herein relates generally to device for connecting coaxial cables, specifically for connecting a plurality of coaxial cables using a single connector housing.

BACKGROUND

Coaxial cables are an ideal medium for transmitting radio frequency ("RF") and microwave signals. Such cables are defined as an electrical cable with an inner, center conductor surrounded by 3 tubular, coaxial layers being, from innermost to outer most, a dielectric layer, a conductive layer and an insulating layer. Generally, the center conductor is operable for the transmission of the RF signal, and the conductive layer (also known as the "shield") provides the return electrical path to the RF power stage. The cables provide both good signal isolation and low signal loss. Due to the wide spread acceptance and use of coaxial cables, many types of connectors are in use. A number of improvements have been made recently to coaxial connectors, predominantly though, for conventional, single conductor coaxial applications.

The ability to carry signals over a wide frequency spectrum is an important goal for coaxial cables. Accordingly, development of cables capable of handling a wide band width is desired in the art. Alternatively, a thin, flexible coaxial cable could be employed in a parallel configuration in effect allowing each coaxial cable to operate in a different frequency range. Bundles of parallel cables would allow higher bandwidth with less interference between channels and frequencies.

Connectors for accommodating coaxial bundles should be easy to assemble with conventional tools, well shielded and maintain a unique orientation. High density connectors for the transmission of RF are known in the art. (See for example US Patent publication 2008/0205829.) While, these connectors may be well suited for many applications, they do not provide for adequate shielding for RF applications. Consequently, what is needed is connector capable of accommodating multiple RF coaxial cables.

SUMMARY OF THE DISCLOSURE

Disclosed herein is a system and method for a connecting device comprising a body having a threaded portion and a sleeve portion. A plurality of coaxial receptacles disposed in the threaded portion, each receptacle formed to couple with element of a coaxial cable connector, and a plurality of coaxial mounts disposed on the sleeve end. The coaxial mounts may be coupled to coaxial leads with each lead having a mini-connectors. The body is substantially similar to a type-n connector and provides for easy coupling of multiple coaxial cables within a single connector housing.

The design and use of the invention, however, together with additional objectives and advantages thereof will be best understood from the following description of specific embodiments when read in connection with the accompanying drawings.

DESCRIPTION

Nomenclature

Figure 1:
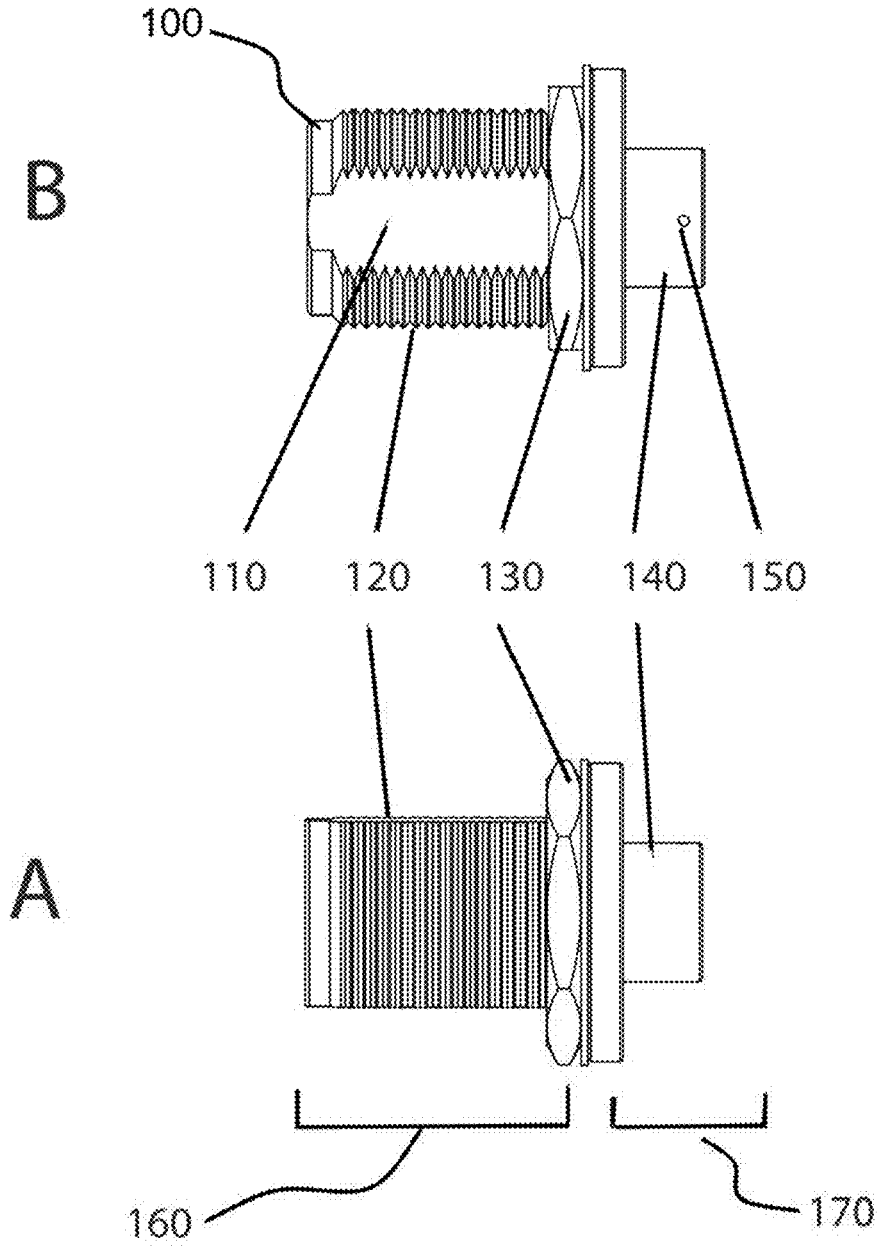
FIG. 1 illustrates a side view and a top view respectively of one aspect of a coaxial cable connector system.

The term "threaded surface" generally refers to a surface having a raised groove-like structure for receiving a reciprocally threaded mating component. A threaded surface may be either male or female depending upon the application.

The term "bulkhead" generally refers to a surface that a connecting device is affixed to. Conventionally, connecting devices have a portion passing through a bulkhead to provide access from an opposite side of a bulkhead.

The term "coaxial element" generally refers to the center conductor, dielectric layer, and conductive layer of a coaxial cable or fitting. A coaxial element may also include the outermost insulating layer.

The term "lead" or leads" generally refer to a length of coaxial cable having one end affixed to an electrical circuit.

The term "mini-connector" generally refers to a connector that is affixed to the distal end of the lead allowing the lead to be connected to other components such as antenna, transmitters and receivers. Mini-connectors are conventionally known in the art. Examples of mini-connectors are micro-coaxial (MCX) and micro-miniature coaxial (MMCX) and the like.

The term "mini-connector center conductor" generally refers to the center conductor of a mini-connector.

The term "mini-connector dielectric" generally refers to the dielectric within a mini-connector.

The term "mini-connector shield" generally refers to the shield of a mini-connector.

The term "coaxial receptacle" generally refers to the collection of coaxial elements generally comprising a center conductor and a dielectric element, disposed to allow for connection and removal of electrically coupled components.

The term "Type N connector" generally refers to a threaded RF connector used to join coaxial cables. Type N connectors are well known in the art. There are two families of Type N connectors: Standard N (coaxial cable) and Corrugated N (helical and annular cable). Their primary applications are the termination of medium to miniature size coaxial cable, including, but not limited to, RG-8, RG-58, RG-141, and RG-225.

The term "RF" or "radio frequency" generally refers to, but is not limited to, electromagnetic energy having a frequency between 1 kHz and 10 GHz.

The term "WiFi" generally refers to, but is not limited to a wireless LAN (local area network).

The term "transmitter" generally refers to an electronic circuit for providing RF energy. Transmitters are often coupled to information systems with the effect of transforming digital information to RF for use in a wireless network.

The term "antenna" generally refers to a device for radiating or receiving RF. Antennas are generally coupled to a transmitter, receiver or both.

The term "receiver" generally refers to an electronic circuit that can convert RF to useful information. Receivers are often coupled to information systems with the effect of transforming RF information to digital information for use in a wireless network.

DETAILED DESCRIPTION

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Read this application with the following terms and phrases in their most general form. These definitions are provided to facilitate a clear understanding of the present invention. The general meaning of each of these terms or phrases is illustrative, and not in any way limiting.

FIG. 1 illustrates a side view and a top view respectively of one aspect of a coaxial cable connector system. In the FIG. 1A, a body 100 having a threaded side 160 is disposed for mating with multiple coaxial cables. The body 100 is preferably made from electrically conducting material such as stainless steel. The body 100 is substantially circular, but may include a flat gripping surface 110. The threaded side 160 has a threaded surface 120 for accepting a gripping nut 130. The body has a sleeve side 170 having an outer shell 140. Disposed in the center of the body is a dielectric material (not shown) for supporting elements within the threaded side 160 and the sleeve side 170. The sleeve side 170 may be formed differently than shown by forming it with a second threaded surface or a quick-disconnect connector form. The shell 140 includes an alignment dimple or "key" 150 dispose along the sleeve side, although the inventors contemplates effectuating the sleeve side 170 with or without the key 150 or by disposing the key 150 in alternative positions.

References in the specification to "one embodiment", "an embodiment", "an example embodiment", etc., indicate that the embodiment described may include a particular feature, structure or characteristic, but every embodiment may not necessarily include the particular feature, structure or characteristic. Moreover, such phrases are not necessarily referring to the same embodiment. Further, when a particular feature, structure or characteristic is described in connection with an embodiment, it is submitted that it is within the knowledge of one of ordinary skill in the art to effectuate such feature, structure or characteristic in connection with other embodiments whether or not explicitly described. Parts of the description are presented using terminology commonly employed by those of ordinary skill in the art to convey the substance of their work to others of ordinary skill in the art.

Figure 2:
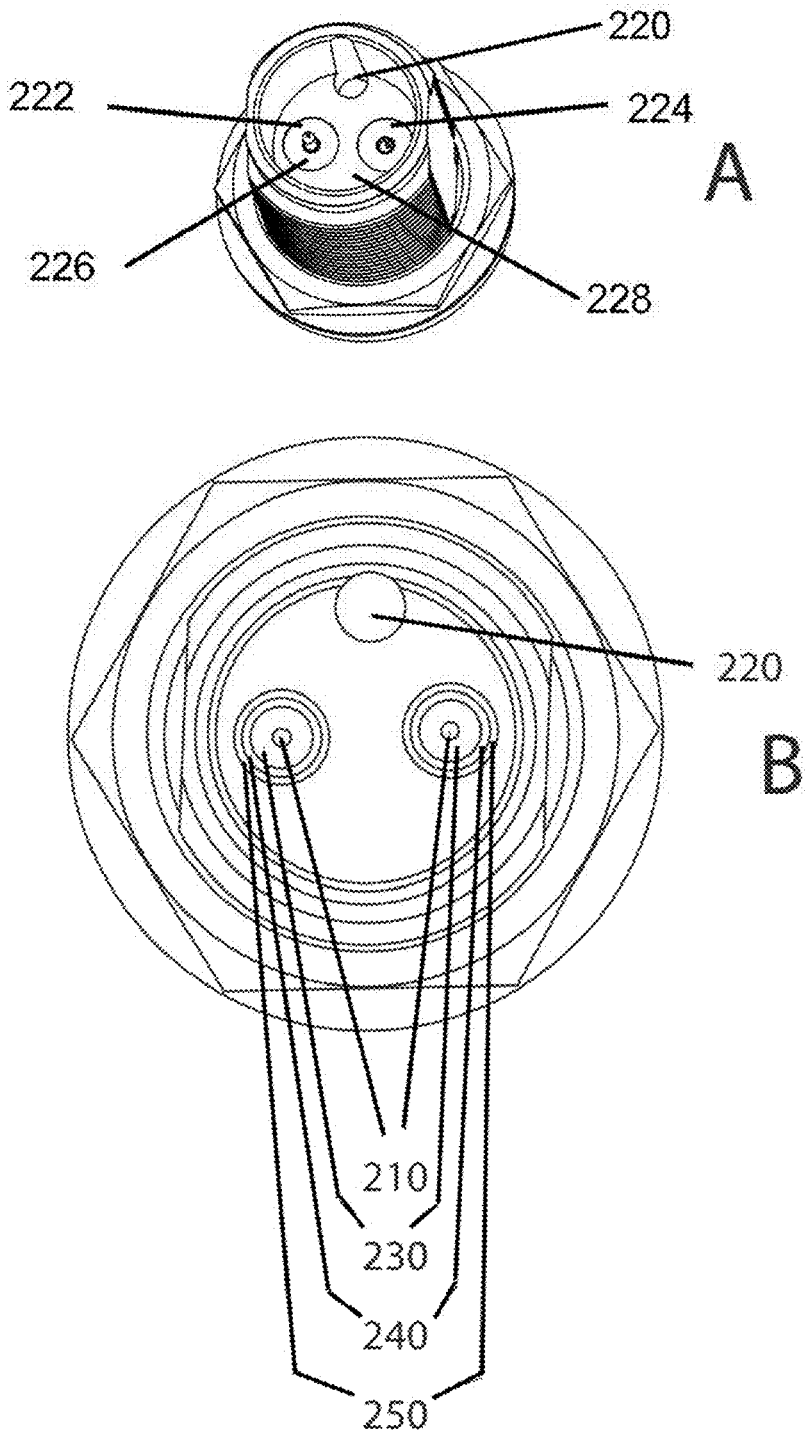
FIG. 2 illustrates the end view of the threaded side of a coaxial cable connector system.

FIG. 2 illustrates the end view of the threaded side 160 of a coaxial cable connector system. Within the threaded side is a cavity ("threaded cavity") containing multiple coaxial receptacles 222 and 224. In the FIG. 2A, the center conductor receptacle may be comprised of a "pin" to effectuate a male connector, or may be formed using a hollowed out protrusion for receiving a pin with the effect of forming a female connector. Receptacle 222 is formed as a male receptacle and receptacle 224 is formed as a female receptacle. Both the receptacle 222 and 224 are electrically isolated from the connector housing 226 by a dielectric layer 226 which surrounds and forms an integral part of each receptacle 222 and 224. A female positioning structure 220 is disposed off center with the effect that an opposite gender positioning structure, when connected acts to align the receptacles. Positioning structures may be either male or female.

In operation each coaxial element within a coaxial receptacle is formed to match and join with the elements of the coaxial cable coupled to it. Thus in the FIG. 2A complementary receptacles and a complementary positioning structure would be disposed to provide for electrical connectivity to a similarly formed coaxial cable connector. In the FIG. 2A, the connector body 228 could be constructed of an electrical conducting material and provide for electrical shield around the coaxial receptacles. In the FIG. 2A, the receptacles 222 and 224 would physically "share" the connector body 228 as a common shield although in effect the electrical shielding for each receptacle would be effectuated by the position of the receptacle in relation to any other receptacles and the connector body 228. Coaxial receptacles and connector materials and shapes could be formed to effectuate optimal impedance matching at anticipated operating frequencies.

FIG. 2B shows a possible alternative embodiment to the threaded side 160 of a coaxial connector system. In the FIG. 2B the coaxial receptacles are formed to allow for each receptacle to include a separate shield. Each coaxial element has a center conductor receptacle 210. The center conductor receptacle 210 may be comprised of a "pin" to effectuate a male connector, or may be formed using a hollowed out protrusion for receiving a pin with the effect of forming a female connector. The center conductor receptacle 210 is surrounded by the dielectric receptacle 230 to electrically isolate the center conductor receptacle 210 from a shield receptacle 240. The dielectric receptacle 230 is surrounded by the shield receptacle 240. Additionally, there may be an optional surrounding layer of the insulator material 250. The center conductor receptacle is contiguous through the coaxial cable connector to couple to a corresponding element on the sleeve side 170. Likewise the shield receptacle may be contiguous through the coaxial cable connector to a corresponding element on the sleeve side 170. Any gaps between receptacle elements within the threaded side may be filled with non-conductive filler material. An alignment receptacle 220 is disposed off center as an asymmetric positioning element.

Figure 3:
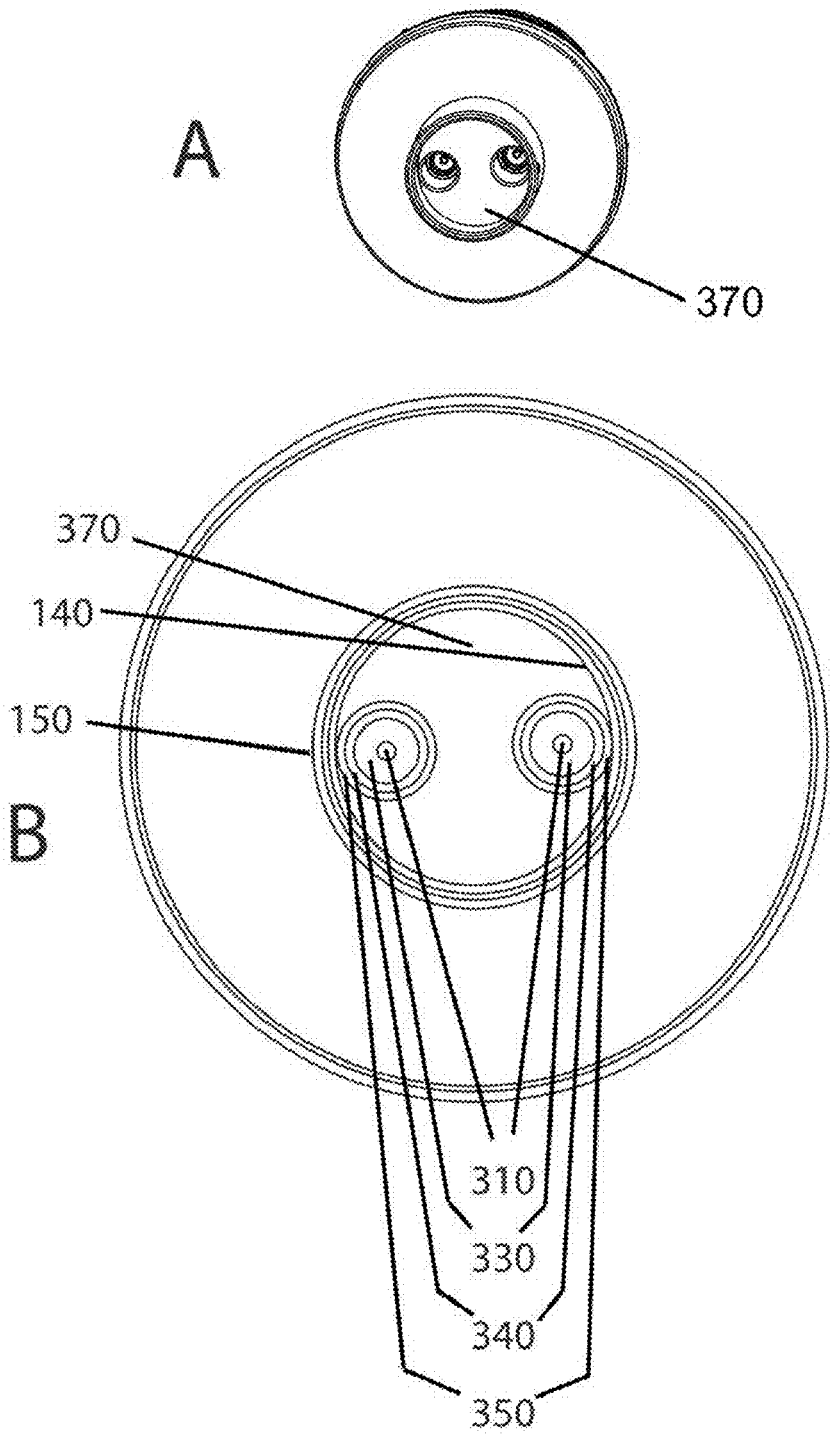
FIG. 3 illustrates the sleeve side of the coaxial cable connector system.

FIG. 3 illustrates the sleeve side 170 of the coaxial cable connector system. Within the sleeve side is a cavity ("sleeve cavity") having multiple coaxial mounts disposed for receiving a wire or other electrical conductive element. A center conductor mount 310 is surrounded by dielectric 330 to electrically isolate the center conductor mount 310 from surrounding material. The center conductor mount 310 is electrically coupled to a respective receptacle element on the reverse side of the connector, and may be formed form the same material. In the FIG. 3A the center conductor mounts 310 receive a conducting wire from a coaxial cable, and the shields form the coaxial cable are electrically connected to the connector body. Thus the center conductor mounts would physically share the connector body as a common shield although in effect the electrical shielding for each receptacle would be effectuated by the position of the receptacle in relation to any other receptacles and the connector body.

In the FIG. 3B, one alternative design is illustrated. In the FIG. 3B the center conductor mounts may be surrounded by individual the shielding 340 which would in turn connect to a coaxial lead. There may also be an optional surrounding layer of the insulator receptacle 350. The gaps between coaxial portion within the sleeve side are filled with non-conductive filler 370. A dimple or other structure (not shown) may be disposed off center on the sleeve side 140 as an asymmetric positioning element. Alternatively, the sleeve side could be replaced with a threaded element and an alignment receptacle could be used instead of a dimple. The coaxial portion elements could be tiered to match a connecting coaxial bundle. Alternatively, the coaxial portion elements could be individual leads protruding from the sleeve side of the connector.

Figure 4:
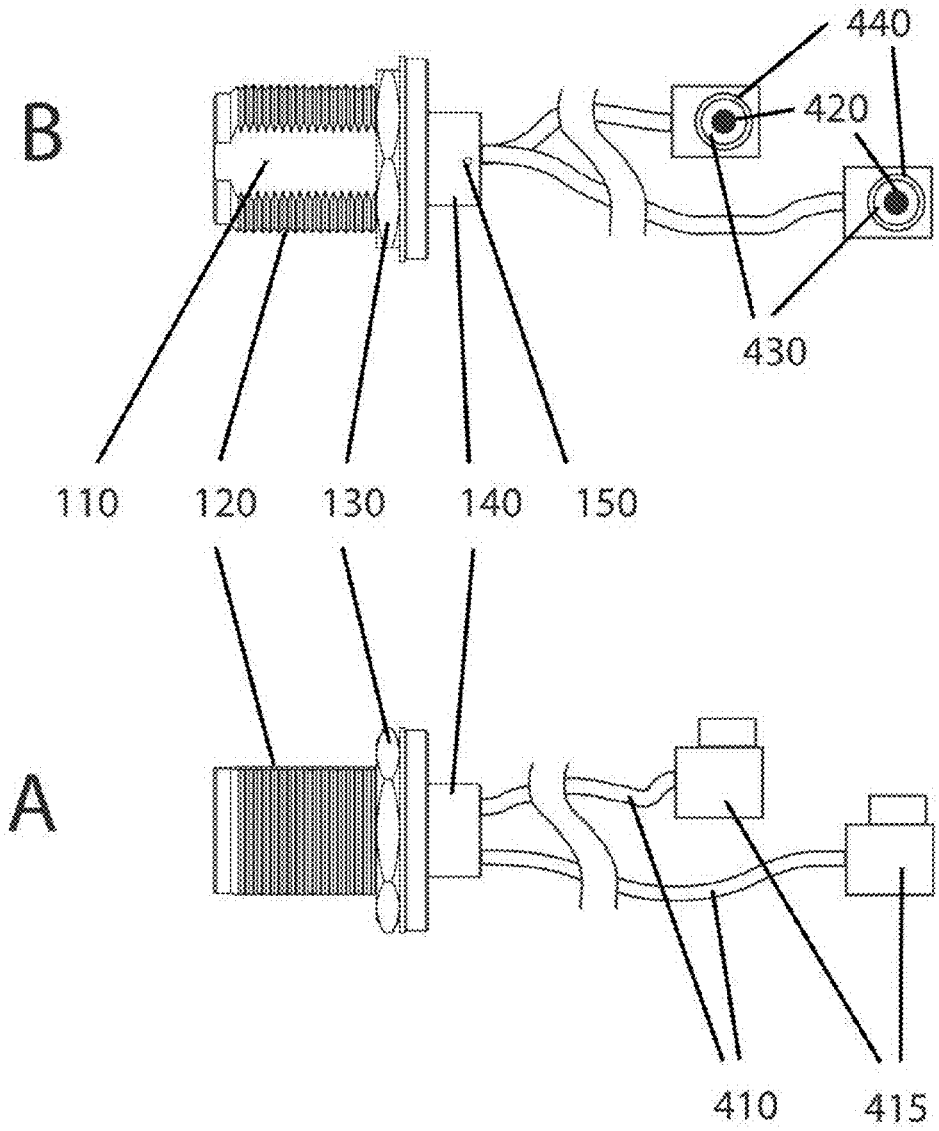
FIG. 4 illustrates the sleeve end in which multiple coaxial mounts in the sleeve end are coupled to leads of indeterminate length, protruding from the sleeve end.

FIG. 4 illustrates the sleeve side in which multiple coaxial mounts in the sleeve side 140 are coupled to leads 410 of indeterminate length, protruding from the sleeve cavity on the sleeve side 140. The leads 410 comprise a center conductor surrounded by 3 tubular, coaxial layers (not shown) being, from innermost to outer most, a dielectric layer, a conductive layer and an insulating layer. A distal mini-connector 415 is affixed to the distal end of the lead 410 and the proximal end of the lead is affixed to a coaxial mount. The center conductor portion is electrically coupled through the lead 410 to the mini-connector center conductor 420. The dielectric portion is electrically coupled through the lead 410 to the mini-connector dielectric 430. A shield mount may electrically coupled to the mini-connector shield 440 or alternatively the shield may be connected to the connector body. The shield is contiguous with the sleeve side 140 or the mini-connector shield 440.

In the FIG. 4, each coaxial element within the coaxial receptacle may be tiered to mate with the coaxial elements of a corresponding coaxial cable. The center conductor receptacle mates with the center conductor of a coaxial cable when the two conductors are held in substantially close proximity to ensure electrical conduction. If employed, the shield receptacle mates with the shield of a coaxial cable when the two conductors are held in close enough proximity to ensure electrical conduction. The dielectric receptacle mates with the dielectric of a coaxial cable when the two insulators are held in close proximity. The coaxial elements within a coaxial receptacle are coupled to their corresponding coaxial elements within a coaxial mount. However, non-conductive elements within a coaxial receptacle may closely align with; though not necessarily contact the corresponding elements of an attached coaxial cable or the coaxial portion.

Similarly, each coaxial element within the coaxial mount may be tiered to mate with corresponding coaxial elements of a coaxial cable. The conductor mount mates with the center conductor of a coaxial cable when the two conductors are firmly held in close enough proximity to ensure electrical conduction. The shield mount, if used, mates with the shield of a coaxial cable when the two conductors are firmly held in close enough proximity to ensure electrical conduction. The dielectric mount mates with the dielectric of a coaxial cable when the two insulators are firmly held in close proximity. The coaxial elements within a coaxial receptacle contiguously or continuously adjoin to the corresponding coaxial elements within a coaxial mount. Non-conductive elements within a coaxial portion may closely align with, though not necessarily connect to, the corresponding elements of an attached coaxial cable.

A plurality of coaxial receptacles are disposed on the end of the threaded side with a substantially equal number of coaxial mounts arrayed on the end of the sleeve side 170 of the coaxial cable connector system.

One having skill in the art will recognize that the design can be effectuated with a coaxial receptacle comprised of a two-tier opening similar to a conventional type N connector. The lower, center tier is a sheath to accept and contact the exposed center conductor of a coaxial cable, the floor of the upper tier is dielectric, the wall of the upper tier is composed of the shield receptacle which is exposed to make contact the exposed shield of the coaxial cable.

The threaded side may be a male thread and coaxial cables, each prepared to mate with a coaxial receptacle are within a bundle such that all the ends are disposed within a female connector. This coaxial cable bundle can then be attached to the coaxial connector system by pressing the threaded side of the coaxial cable connector system into the female connect, ensuring the alignment pin of the female engages the recess in the male end, then tightening the female connector on the male thread. In another embodiment, the threaded side is a female thread and has no gripping nut or flat gripping surface, and the cable bundle is disposed in a connector having a male thread.

Alternatively, the sleeve portion on the sleeve side is a quick disconnect coupling. In this case, the coaxial cables, each prepared to mate with a coaxial portion, are within a bundle such that all the ends are disposed within a mating quick disconnect coupling. This coaxial cable bundle can then be attached to the coaxial connector system by pressing the quick disconnect side of the coaxial cable connector system into the mating quick disconnect of the cable bundle, ensuring the alignment dimple of the quick disconnect end of the coaxial cable connector system aligns with the mating groove of the mating quick disconnect of the cable bundle, then tightening the quick disconnect fittings.

As another alternative, each coaxial portion is affixed to a coaxial lead as shown in the FIG. 4. A coaxial connector is attached to each lead. These connectors can then be connected to other devices including, but not limited to receivers, transmitters or antennas. A plurality of antennas, for example, may be connected severally to a plurality of coaxial cables through the coaxial connector system, each carrying the same or different frequency. The coaxial connector system may also have a common ground plane to which the coaxial receptacles and coaxial portions are jointly connected.

One having skill in the art will also recognize that differing physical connections could be used. For example, the male threaded surface does not require a flat gripping surface, or the sleeve side does not have an alignment dimple, or the threaded end does not have an alignment receptacle. An asymmetric arrangement of the coaxial receptacles and coaxial portions would provide for unique alignment.

The invention described herein addresses the deficiencies of previously described devices. In the present invention, a bundle of coaxial cables can be quickly attached with a quick disconnect. Through connection of the shield of each coaxial cable to a common ground plane within the connector through to the ground shield of the quick disconnect, shield continuity is maintained for each coaxial cable.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims. Accordingly, it is appropriate that the appended claims be construed broadly and in a manner consistent with the scope of the invention, as set forth in the following claims.

What is claimed is:

1. A device comprising:

a body having a threaded cavity and a sleeve cavity;

a plurality of coaxial receptacles disposed in the threaded cavity, each coaxial receptacle comprising a substantially circular center conductor disposed in a substantially circular dielectric, said dielectric disposed within a conductive layer, wherein the center conductor, dielectric and conductive layer effectuate a predetermined impedance, and a plurality of coaxial mounts disposed on the sleeve cavity, said mounts each electrically coupled to a corresponding coaxial receptacle.

2. The device of claim 1 further comprising:

one or more dielectric insulators disposed around the receptacles or mounts.

3. The device of claim 1 wherein the coaxial mounts are coupled to coaxial leads.

4. The device of claim 2 wherein the coaxial leads are coupled to mini-connectors.

5. The device of claim 1 wherein the body is substantially similar to a type-n connector.

6. The device of claim 1 further comprising:

a positioning key disposed on the threaded portion, wherein the key is operable to prevent improper coupling of the threaded portion.

7. The device of claim 1 wherein the sleeve cavity is either threaded or a quick disconnect.

8. The device of claim 1 wherein the threaded cavity is either male or female.

9. The device of claim 1 wherein the predetermined impedance is substantially 50 ohms or substantially 75 ohms.

10. The device of claim 1 wherein each receptacle's conductive layer is electrically isolated from other conductive layers.

11. The device of claim 1 where each receptacle shares a common conductive layer.

12. A device comprising:

a substantially circular body, said body comprised of electrically conductive material;

a threaded portion formed on one end of the body;

a sleeve portion formed on the body opposite of the threaded portion;

an electrically conductive separator disposed in the body to form a threaded cavity and a sleeve cavity;

a plurality of coaxial receptacles disposed through the separator, said receptacles comprised of a substantially circular center conductor disposed in a substantially circular dielectric, wherein the center conductor and the dielectric and separator effectuate an impedance of either substantially 50 ohms or substantially 75 ohms, a plurality of coaxial mounts, said coaxial mounts disposed in the dielectric material and coupled to respective coaxial receptacles.

13. The device of claim 12 further comprising:

a plurality of coaxial cables coupled to the coaxial mounts, said cables each having a connector disposed distal to the coaxial mounts.

* * * * *